US012252315B2

(12) United States Patent
De Paola et al.

(10) Patent No.: US 12,252,315 B2
(45) Date of Patent: Mar. 18, 2025

(54) SPOUT FOR A PACKAGE AND PACKAGE-SPOUT ASSEMBLY

(71) Applicant: TETRA LAVAL HOLDINGS & FINANCE S.A., Pully (CH)

(72) Inventors: Rocco De Paola, Modena (IT); Angelo Sorbara, Rubiera (IT); Franco Cani, Modena (IT); Joachim Kristofer Bjurenheim, Rubiera (IT); Sara Bertoncini, Modena (IT); James Maxwell Eelbeck, Portishead (GB); Sarah Anne Dickins, Bristol (GB); Alessandro Morselli, Castelfranco Emilia (IT); Mariastella Oriolo, Modena (IT); Tiziano Viani, Bibbiano (IT); Pietro Martini, Parma (IT); Livio Veronesi, San Felice sul Panaro (IT); Giulio Bertani, Carpi (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 701 days.

(21) Appl. No.: 17/428,082

(22) PCT Filed: Jan. 30, 2020

(86) PCT No.: PCT/EP2020/052202
§ 371 (c)(1),
(2) Date: Aug. 3, 2021

(87) PCT Pub. No.: WO2020/160984
PCT Pub. Date: Aug. 13, 2020

(65) Prior Publication Data

US 2022/0119174 A1 Apr. 21, 2022

(30) Foreign Application Priority Data

Feb. 4, 2019 (EP) ..... 19155214

(51) Int. Cl.
*B65D 51/22* (2006.01)
*B65D 5/74* (2006.01)
(Continued)

(52) U.S. Cl.
CPC ..... *B65D 51/222* (2013.01); *B65D 5/748* (2013.01); *B65D 47/0838* (2013.01);
(Continued)

(58) Field of Classification Search
CPC ..... B65D 51/222; B65D 5/748; B65D 5/747; B65D 47/0838; B65D 85/72; B65D 2251/0025; B65D 2241/0093
See application file for complete search history.

(56) References Cited

U.S. PATENT DOCUMENTS 4,941,580 A 7/1990 Julian
5,141,133 A * 8/1992 Ninomiya ..... B67B 7/26 222/541.2
(Continued)

FOREIGN PATENT DOCUMENTS

CN 1047656 A 12/1990
CN 101827757 A 9/2010
(Continued)

OTHER PUBLICATIONS

International Search Report (PCT/ISA/210) and Written Opinion (PCT/ISA/237) mailed on Mar. 18, 2020, by the Japanese Patent Office as the International Searching Authority for International Application No. PCT/EP2020/052202.
(Continued)

*Primary Examiner* — Nathan J Jenness
*Assistant Examiner* — Jennifer Castriotta
(74) *Attorney, Agent, or Firm* — BUCHANAN INGERSOLL & ROONEY PC

(57) ABSTRACT

A spout includes a base frame fittable about a designated package pour opening surface area, an opening assembly
(Continued)

moveably coupled to the base frame and adapted to at least partially cut/rupture/open/pierce the pour opening surface area, and a control device configured to control the opening assembly. The control device comprises at least one interaction element connected to the opening assembly, at least one control ring rotatably coupled to the base frame and at least one interaction member connected/coupled to the control ring and configured to interact with the interaction element. In use, upon rotating the control ring, the interaction member interacts with the interaction element to induce translation of a cutter of the opening assembly for controlling the opening assembly from a rest configuration to an operative configuration and an axial end portion of the interaction member is arranged within a rotation plane fixed relative to the base frame.

21 Claims, 12 Drawing Sheets

(51) Int. Cl.
*B65D 47/08* (2006.01)
*B65D 85/72* (2006.01)

(52) U.S. Cl.
CPC ..... *B65D 85/72* (2013.01); *B65D 2251/0025* (2013.01); *B65D 2251/0093* (2013.01)

(56) References Cited

U.S. PATENT DOCUMENTS

| | | | | |
|---|---|---|---|---|
| 5,366,114 | A * | 11/1994 | Bernstein | B65D 5/748 222/89 |
| 6,364,164 | B1 * | 4/2002 | Troiano | B65D 5/748 220/297 |
| 6,820,764 | B2 * | 11/2004 | Miani | B65D 5/748 222/91 |
| 7,207,465 | B2 * | 4/2007 | Weist | B65D 5/748 222/83 |
| 7,458,486 | B2 * | 12/2008 | Weist | B65D 5/748 222/83 |
| 2010/0206915 | A1 * | 8/2010 | Miyazaki | B65D 51/228 222/541.8 |
| 2010/0264146 | A1 | 10/2010 | Casale et al. | |
| 2013/0043260 | A1 * | 2/2013 | Barron | B65D 5/748 220/694 |
| 2015/0225142 | A1 | 8/2015 | Agassi et al. | |
| 2022/0119174 | A1 | 4/2022 | De Paola et al. | |

FOREIGN PATENT DOCUMENTS

| | | | |
|---|---|---|---|
| CN | 101848841 | A | 9/2010 |
| CN | 102883963 | A | 1/2013 |
| CN | 213229744 | U | 5/2021 |
| DE | 102010028518 | A1 | 11/2011 |
| EP | 2218651 | A1 | 8/2010 |
| RU | 2497734 | C2 | 11/2013 |

OTHER PUBLICATIONS

Office Action (The First Office Action) issued Mar. 21, 2023, by the State Intellectual Property Office of People's Republic of China in corresponding Chinese Patent Application No. 202010078511.0 and an English Translation of the Office Action. (21 pages).

Office Action issued Jul. 19, 2023, by the Russian Patent Office in corresponding Russian Patent Application No. 2021124199/11(050795) and an English translation of the Office Action. (14 pages).

* cited by examiner

SPOUT FOR A PACKAGE AND PACKAGE-SPOUT ASSEMBLY

TECHNICAL FIELD

The present invention relates to a spout for a package, in particular a package filled with a pourable product, even more particular a package filled with a pourable food product.

The present invention also relates to a package-spout assembly having a package, in particular a package filled with a pourable product, even more particular a package filled with a pourable food product, and a spout arranged on the package.

BACKGROUND ART

As is known, many liquid or pourable food products, such as fruit juice, UHT (ultra-high-temperature treated) milk, wine, tomato sauce, etc., are sold in packages made of sterilized packaging material.

A typical example is the parallelepiped-shaped package for pourable food products known as Tetra Brik Aseptic (registered trademark), which is made by sealing and folding a laminated strip packaging material. The packaging material has a multilayer structure comprising a carton and/or paper base layer, covered on both sides with layers of heat-seal plastic material, e.g. polyethylene. In the case of aseptic packages for long-storage products, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Some versions of these packages comprise a piercable and/or rupturable designated pour opening surface area and a spout being fitted to the package.

A typical spout comprises a base frame fitted about the designated pour opening surface area and having a collar defining an inner space and a pouring outlet, a ring-shaped cutter being moveably arranged within the inner space and a threaded lid to be screwed onto the collar so as to close or open the pouring outlet.

The lid also comprises a plurality of flaps protruding with the lid applied on the collar from the lid into the inner space and being configured to contact respective interaction elements of the cutter. During the first un-screwing of the lid each flap interacts with the respective interaction element so as to induce a rototraslatory movement of the cutter for directing the cutter towards and through the designated pour opening surface area. The rototraslatory movement of the cutter is also defined by means of a cam mechanism of which a portion is provided on the inner surface of the collar and another portion is provided on an outer surface of the cutter facing the inner surface of the collar.

A drawback of these kind of spouts is seen in that the control of the cutter requires the lid to be detached. This can lead to losing the lid.

DISCLOSURE OF INVENTION

It is therefore an object of the present invention to provide in a straightforward and low-cost manner an improved spout for a sealed package, in particular filled with a pourable product, even more particular filled with a pourable food product.

It is a further object of the present invention to provide in a straightforward and low-cost manner a package-spout assembly having a sealed package, in particular filled with a pourable product, even more particular filled with a pourable food product, and a spout.

According to the present invention, there is provided a spout according to the independent claim.

Further advantageous embodiments of the spout are specified in the dependent claims.

According to the present invention, there is also provided a package-spout assembly according to claim 16.

BRIEF DESCRIPTION OF THE DRAWINGS

Two non-limiting embodiments of the present invention will be described by way of example with reference to the accompanying drawings, in which.

BEST MODES FOR CARRYING OUT THE INVENTION

Number 1 indicates as a whole a package-spout assembly comprising:

- a sealed package 2, in particular a sealed carton package, having a designated pour opening surface area (not shown and known as such); and
- a spout 3, in particular a plastic spout, fitted to package 2 about the designated pour opening surface area.

Preferably but not necessarily, package 2 is filled with a pourable product, in particular a pourable food product, even more particular a sterilized and/or a sterile-processed pourable food product, such as milk or fruit juice.

Package 2 is obtained from a web of packaging material having a multilayer structure (not shown), and comprises at least a layer of fibrous material, e.g. a paper or cardboard, and at least two layers of heat-seal plastic material, e.g. polyethylene, interposing the layer of fibrous material in between one another. One of these two layers of heat-seal plastic material defining the inner face of package 2 contacting the pourable product.

Preferably but not necessarily, the web of packaging material also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially but not necessarily, the web of packaging material also comprises a further layer of heat-seal plastic material being interposed between the layer of gas- and light-barrier material and the layer of fibrous material.

According to a preferred non-limiting embodiment, spout (s) 3 is (are) applied to package(s) 2 prior, during or after forming, filling and sealing of package(s) 2 by means of a molding process and/or adhesive bonding and/or welding bonding.

Alternatively, spout(s) 3 can be applied onto the web of packaging material prior to arranging the web of packaging material within or during advancement of the web of packaging material through a packaging machine for forming, filling and sealing packages 2 from the web of packaging material.

Figure 1:
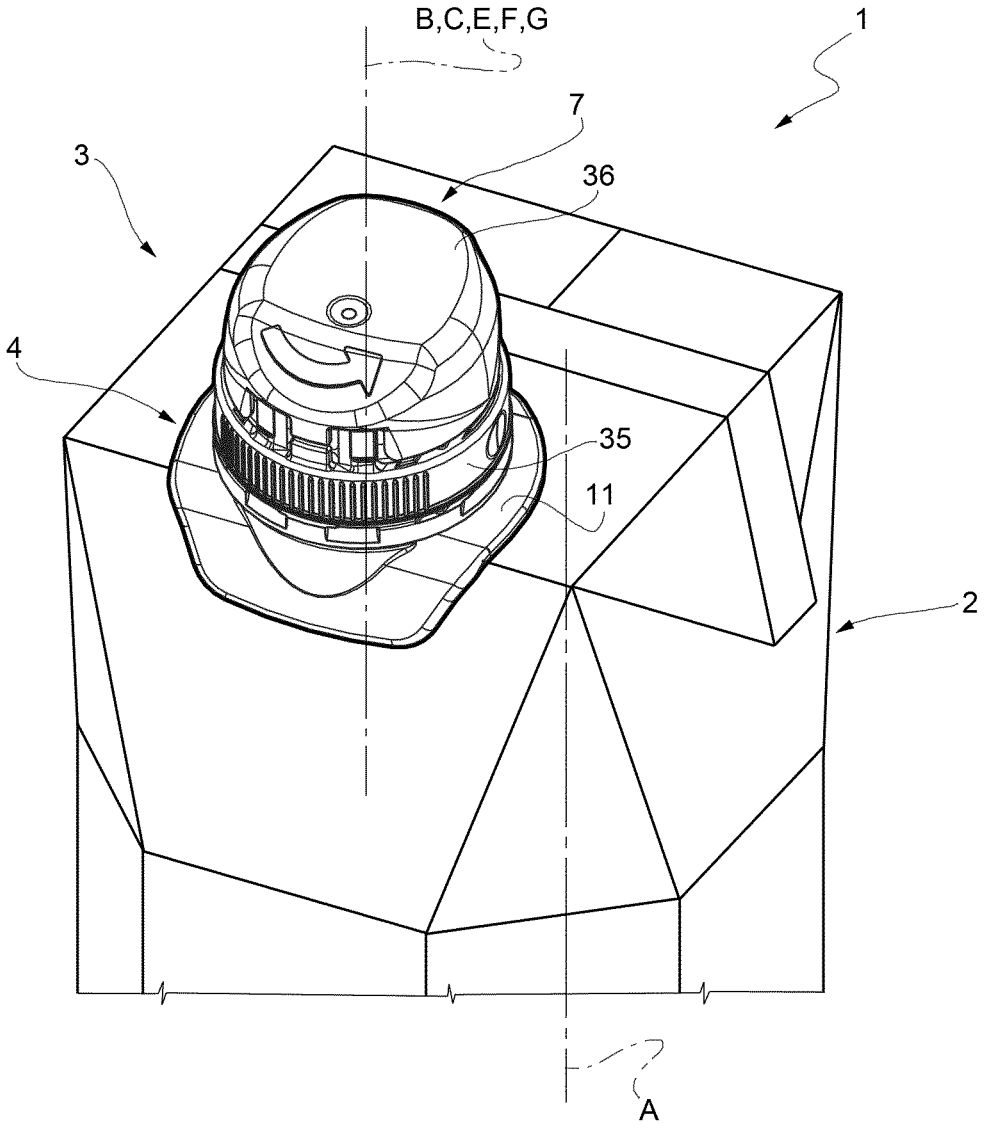
FIG. 1 is a schematic perspective view of a package-spout assembly having a spout according to a first embodiment of the present invention arranged in a first configuration, with parts removed for clarity.
Figure 2:
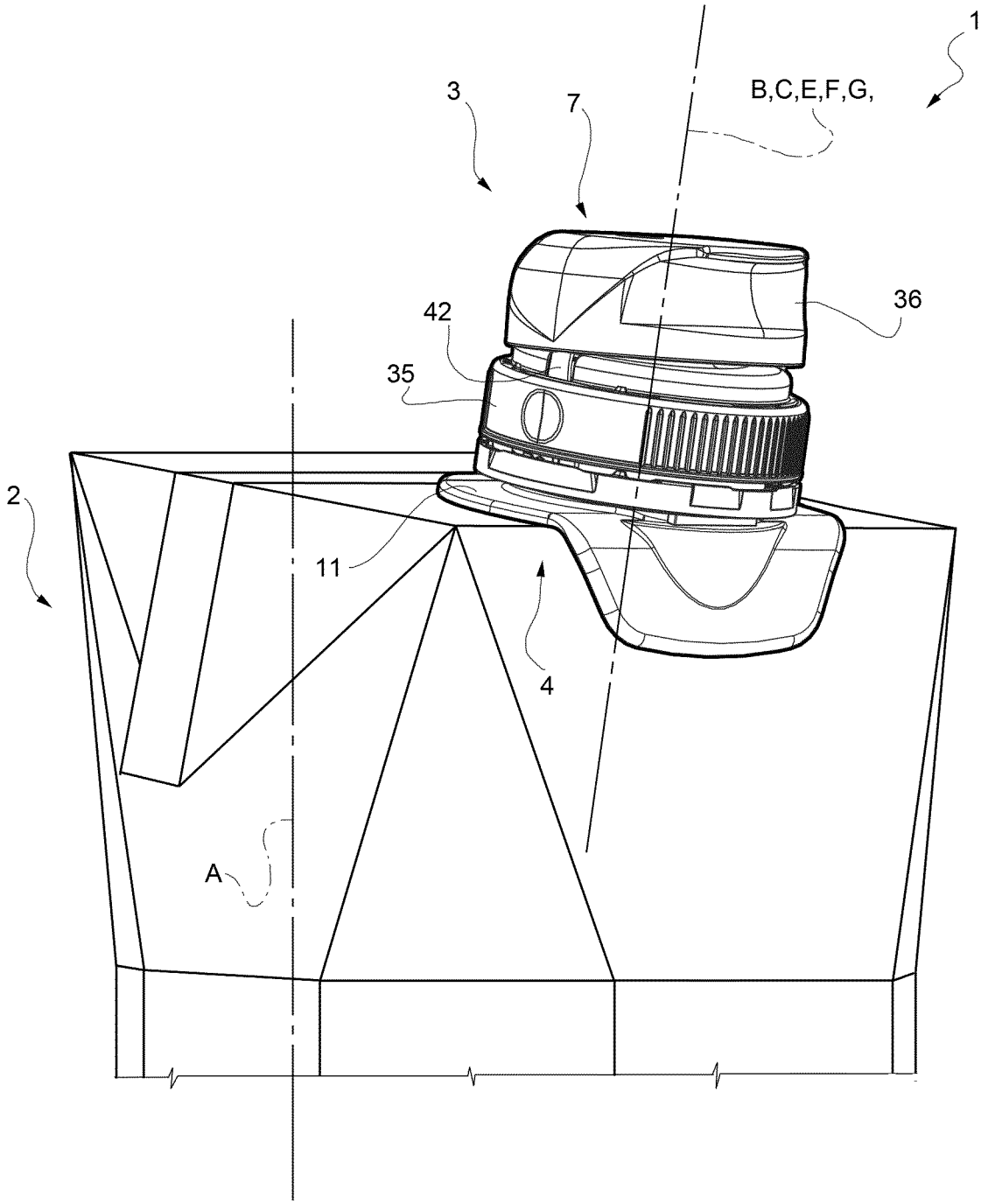
FIG. 2 is a schematic perspective view of the package-spout assembly of FIG. 1 with the spout being arranged in a second configuration, with parts removed for clarity.
Figure 3:
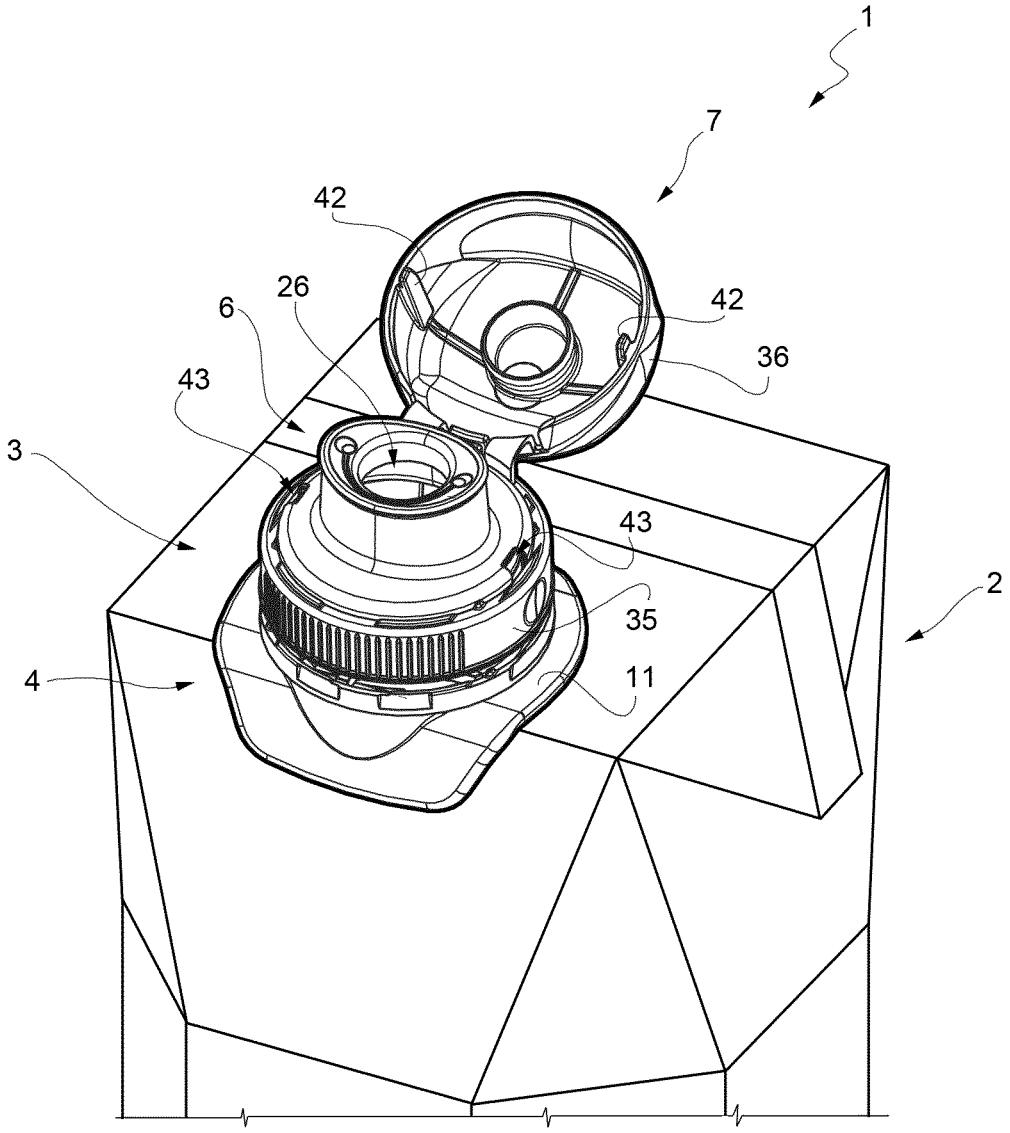
FIG. 3 is a schematic perspective view of the package-spout assembly of FIG. 1 with the spout being arranged in a third configuration, with parts removed for clarity.

With particular reference to FIGS. 1 and 3, package 2 extends along a longitudinal axis A Preferentially but not necessarily, package 2 is parallelepiped-shaped.

In particular, the designated pour opening surface area of package 2 is configured to be at least partially (non-reversibly) opened and/or ruptured and/or cut and/or pierced so as to allow the out-pouring of the pourable product from package 2, in particular through spout 3. Even more particular, the designated pour opening surface area is configured to allow the out-pouring of the pourable product after its loss of integrity and to protect the pourable product from the outer environment prior to its cutting and/or opening and/or rupturing and/or piercing.

According to a preferred non-limiting embodiment, the designated pour opening surface area comprises a separation membrane (not shown and known as such) configured to be ruptured and/or opened and/or cut and/or pierced. In particular, the separation membrane separates in the area of, in particular at, the designated pour opening surface area the inside of package 2 from the outside of package 2. Preferentially but not necessarily, the separation membrane comprises a gas- and light-barrier material, e.g. aluminum foil or ethylene vinyl alcohol (EVOH) film.

According to a preferred non-limiting embodiment, the separation membrane is defined by a portion of the web of packaging material, in particular a portion of the layers of the web of packaging material being different from the layer of fibrous material.

Figure 4:
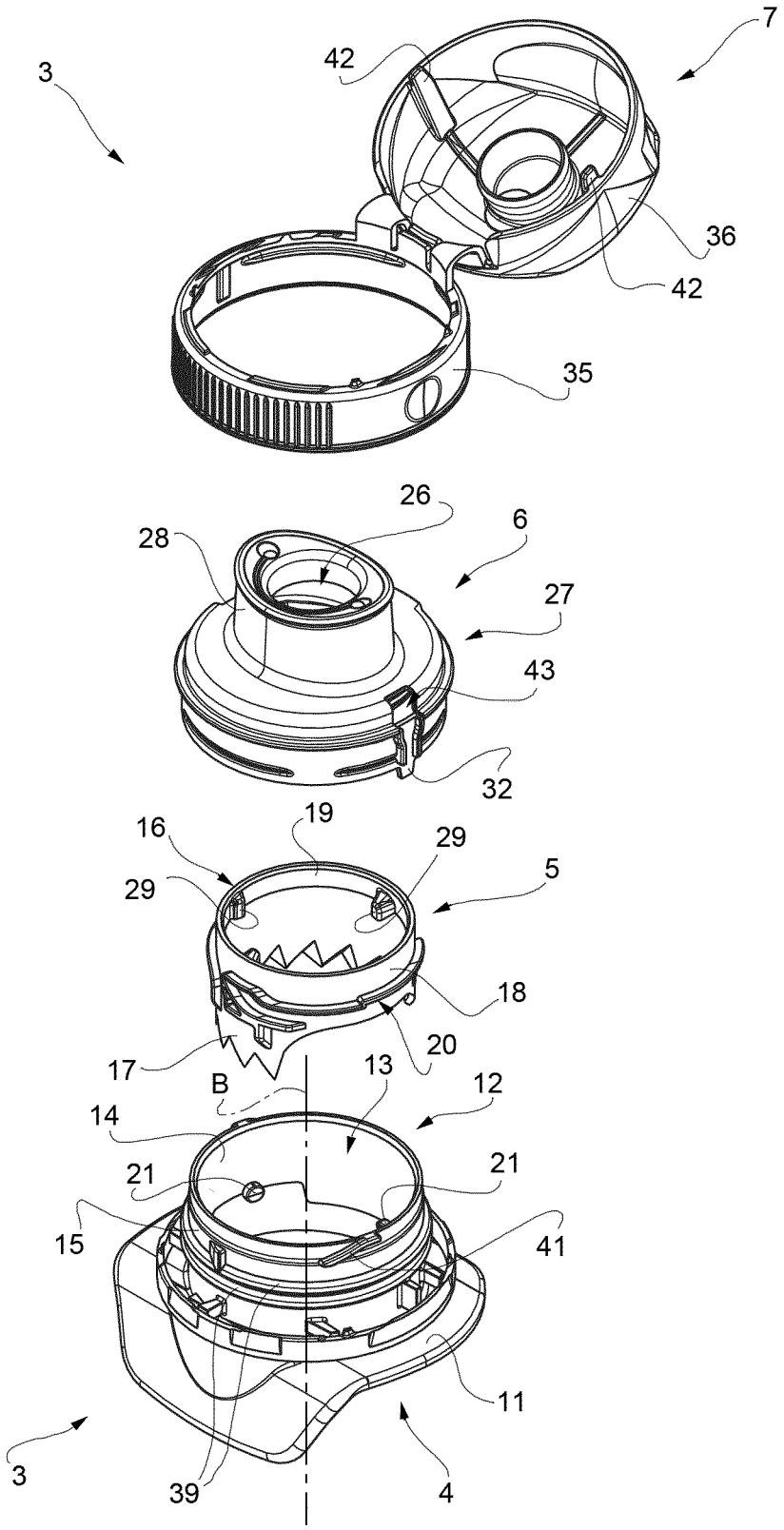
FIG. 4 is an exploded view of the spout of FIGS. 1 to 3, with parts removed for clarity.

With particular reference to FIG. 4, spout 3 comprises at least:

- a base frame 4 configured to be fitted about the designated pour opening surface area of package 2;
- an opening assembly 5 moveably coupled to base frame 4 and being adapted to at least partially cut and/or rupture and/or open and/or pierce the designated pour opening surface area; and
- a control device configured to interact with opening assembly 5 and to control opening assembly 5 between a rest configuration, in particular in which opening assembly 5 with base frame 4 being fitted around the designated pour opening surface area, in particular the separation membrane, is retracted from the designated pour opening surface area (i.e. opening assembly 5 does not, in use, open and/or cut and/or rupture and/or pierce the designated pour opening surface area, in particular the separation membrane, when being controlled in the rest configuration), and an operative configuration in which opening assembly 5 with base frame 4 being, in use, fitted about the designated pour opening surface area, in particular the separation membrane, is configured to at least partially cut and/or rupture and/or open and/or pierce the designated pour opening surface area, in particular the separation membrane.

According to a preferred non-limiting embodiment, spout 3 also comprises an outlet cap 6 configured to allow, in use, the outflow of the pourable product from package 2 with spout 3 being arranged on package and with the designated pour opening surface area, in particular the separation membrane, being at least partially opened and/or cut and/or ruptured and/or pierced.

According to a preferred non-limiting embodiment, spout 3 also comprises, a lid assembly 7 for at least selectively closing or opening outlet cap 6 and being controllable between at least a closing configuration (see FIG. 1) in which lid assembly 7 closes and/or covers outlet cap 6, in particular for hindering any out-pouring of the pourable product from package 2, and an open configuration (see FIG. 3) in which lid assembly 7 opens outlet cap 6, in particular for allowing the out-pouring of the pourable product from package 2.

Figure 6A:
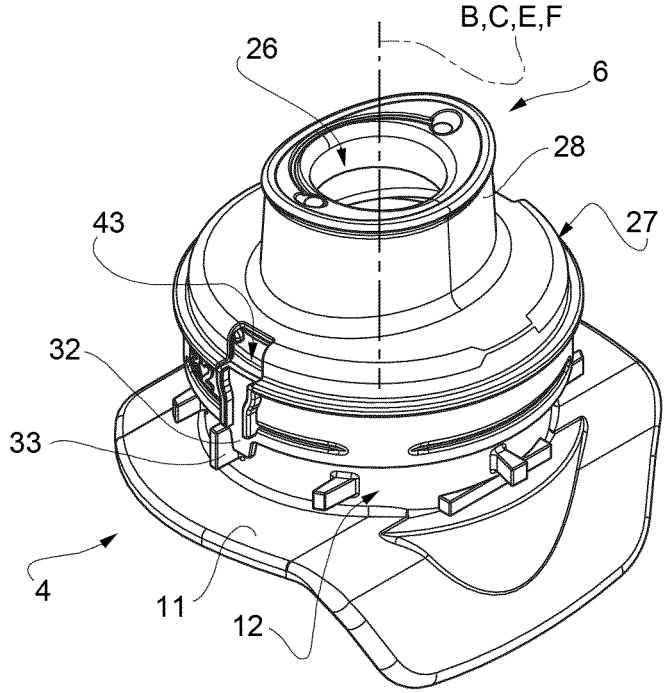
FIGS. 6*a* and 6*b* are perspective views of other details of the spout of FIGS. 1 to 4 arranged respectively in a first configuration and a second configuration, with parts removed for clarity.
Figure 6B:
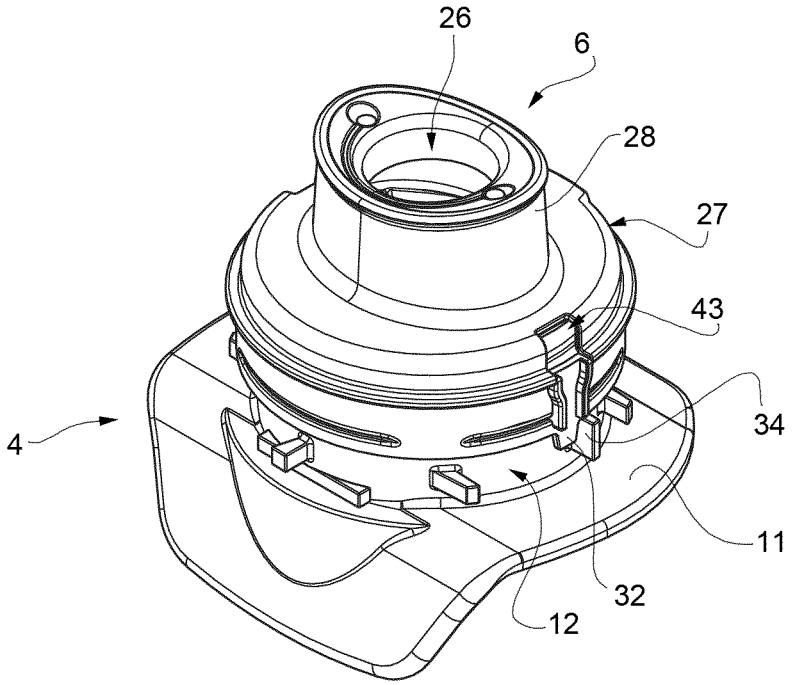

With particular reference to FIGS. 4, 6*a* and 6*b*, base frame 4 comprises a coupling base 11 configured to couple and/or connect spout 3 to package 2 and a collar 12 defining and/or delimiting an inner space 13 and being connected to coupling base 11.

Preferentially but not necessarily, coupling base 11 is configured to be fixed and/or is fixed to an outer surface of package 2, in particular in the area of, even more particular at, the designated pour opening surface area.

In particular, coupling base 11 comprises an opening, in particular a circular opening, and collar 12 surrounds the opening so that, in use, with the designated pour opening surface area being opened and/or cut and/or ruptured and/or pierced and spout 3 being fitted to package 2 a fluid connection between the inside of package 2 and inner space 13 is established (i.e. the pourable product can flow into at least a portion of inner space 13).

Preferentially but not necessarily, at least a portion of coupling base 11 has substantially a plate-like configuration.

Preferentially but not necessarily, collar 12 extends, in particular from coupling base 11, along, in particular parallel to, a longitudinal axis B, in particular longitudinal axis B being a central axis of collar 12.

According to a preferred non-limiting embodiment, collar 12 has a circular shape, in particular a circular cross-sectional shape with respect to a sectional plane being orthogonal to axis B.

According to a preferred non-limiting embodiment, collar 12 comprises an inner surface 14 facing inner space 13 and an outer surface 15 being opposed to inner surface 14 (and inner space 13).

Figure 5A:
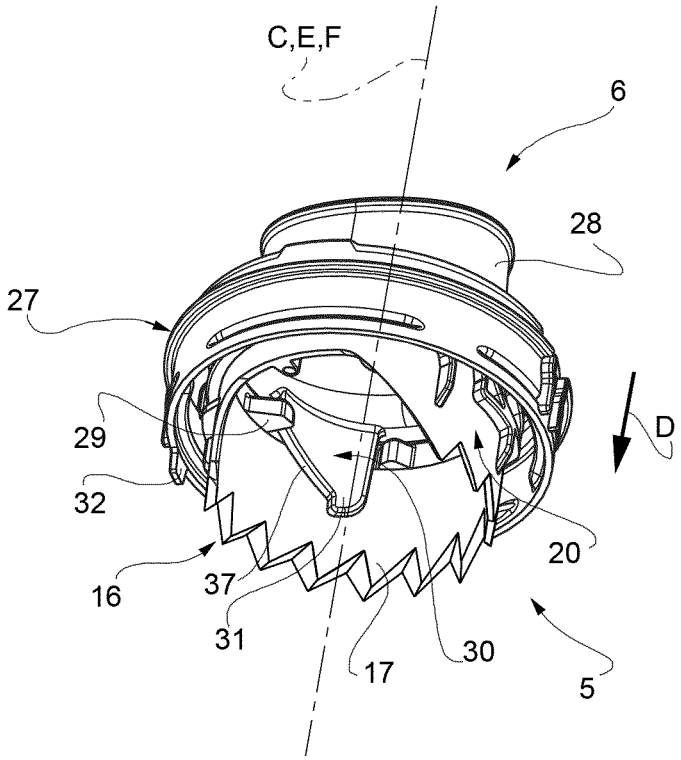
FIGS. 5*a* and 5*b* are perspective views of details of the spout of FIGS. 1 to 4 arranged respectively in a first configuration and a second configuration, with parts removed for clarity.
Figure 5B:
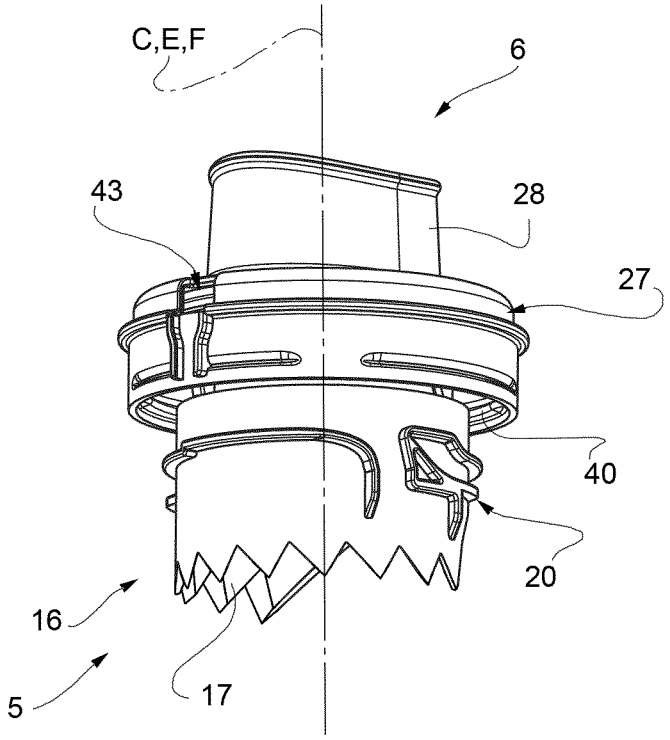

With particular reference to FIGS. 4, 5*a* and 5*b*, at least a portion of opening assembly 5 is configured to at least translate, in particular to rotate and translate, in order to control opening assembly 5 from the rest configuration to the operative configuration.

According to a preferred non-limiting embodiment, opening assembly 5 comprises a (ring-shaped) cutter 16 of which at least a cutting section 17 (of an axial end portion of cutter 16) is adapted to open and/or cut and/or rupture and/or pierce the designated pour opening surface area, in particular the separation membrane.

According to a preferred non-limiting embodiment, in use, during control of opening assembly 5 from the rest configuration to the operative configuration, at least cutter 16 approaches the designated pour opening surface area, in particular the separation membrane, until contacting and preferentially at least partially penetrating the designated pour opening surface area, in particular the separation membrane.

In particular, cutter 16 is moveable between a rest position in which operative assembly 5 is in the rest configuration and an operative position in which operative assembly 5 is in the operative configuration. In particular, cutter 16 is, with spout 3 being arranged on package 2, distanced and/or spaced apart from the designated pour opening surface area, in particular the separation membrane, when being arranged in the rest position and cuts and/or opens and/or ruptures and/or pierces the designated pour opening surface area, in particular the separation membrane, when being arranged in the operative position.

Preferentially but not necessarily, cutter 16 comprises an outer lateral surface 18 and an inner lateral surface 19.

Preferentially but not necessarily, cutting section 17 has (comprises) a serrated profile.

According to a preferred non-limiting embodiment, at least a portion of opening assembly 5, in particular cutter 16, is moveably arranged within inner space 13. In particular cutter 16, even more particular at least outer lateral surface 18, at least partially contacts inner surface 14.

According to a preferred non-limiting embodiment, cutter 16 is configured to at least translate, in particular to rotate and translate, upon activation of the control device, so as to move from the rest position to the operative position (i.e. when controlling, in use, operative assembly 5 from the rest configuration to the operative configuration).

In more detail, cutter 16 is rotatable around a central axis C of cutter 16 itself, in particular axis C being parallel, even more particular coaxial, to axis B, and is configured to move along a direction D parallel to axis C (and B), in particular towards (and through) the designated pour opening surface area, in particular the separation membrane.

In particular, the control device is configured to actuate, in use, rotation of cutter 16 around axis C and translation of cutter 16 along direction D for controlling opening assembly 5 from the rest configuration to the operative configuration.

According to a preferred non-limiting embodiment, the control device comprises a cam group configured to guide movement of cutter 16 from the rest position to the operative position.

Preferentially but not necessarily, the cam group comprises a cam profile 20 and at least one, preferentially a plurality of, guiding element(s) 21, cam profile 20 and guiding element(s) 21 being configured to guide in cooperation with one another cutter 16 during movement between the rest position and the operative position.

According to a preferred non-limiting embodiment, cam profile 20 and guiding element(s) 21 cooperate in such a manner that cutter 16 executes, in use, a rototraslatory movement when moving from the rest position to the operative position.

Preferentially but not necessarily, cam profile 20 is associated and/or connected to and/or integral to cutter 16, even more particular to outer lateral surface 18. In particular, cam profile 20 protrudes from and/or is integral to cutter 16, in particular outer lateral surface 18.

Preferentially but not necessarily, guiding element(s) 21 is/are connected and/or associated and/or integral to base frame 4, in particular collar 12, even more particular to inner surface 14. In particular, guiding element(s) 21 protrude(s) from and/or is/are integral to inner surface 14.

With particular reference to FIGS. 4, 6*a* and 6*b*, outlet cap 6 is rotatably coupled to base frame 4, in particular collar 12, in particular outlet cap 6 is rotatable around a respective rotation axis E.

According to a preferred non-limiting embodiment and as will be described in further detail further below, outlet cap 6 carries and/or comprises at least a portion of the control device, in particular the respective portion of the control device being integral to outlet cap 6.

More specifically, spout 3, in particular outlet cap 6, comprises a pouring outlet 26 configured to allow a controlled out-pouring of the pourable product.

Even more specifically, outlet cap 6 comprises a coupling ring 27 configured to rotatably couple outlet cap 6 itself to collar 12 and, preferably but not necessarily a stub 28, in particular realized as a mouthpiece, having pouring outlet 26.

Preferentially but not necessarily, coupling ring 27 contacts at least collar 12, in particular at least outer surface 15, even more particular outer surface 15 and inner surface 14.

In particular, a respective inner surface of coupling ring 27 faces outer surface 15 and, in particular is at least partially in contact with outer surface 15.

In particular, coupling ring 27 at least partially surrounds a portion of collar 12.

According to a preferred non-limiting embodiment, coupling ring 27 is coaxial to collar 12.

With particular reference to FIGS. 4, 5*a*, 5*b*, 6*a* and 6*b*, the control device comprises:

- a plurality of interaction elements 29 connected to, in particular integral to, opening assembly 5, in particular cutter 16;
- at least one control ring rotatably coupled to base frame 4, in particular collar 12, around a rotation axis F, in particular parallel to axis B and/or axis C and/or axis E, even more particular coaxial to axis B and/or axis C and/or axis E; and
- a plurality of interaction members 30 connected to and/or coupled to the control ring and each one being configured to interact with one respective interaction element 29.

In particular, each interaction member 30 is coupled and/or connected to the control ring such that a rotation of the control ring around axis F induces also a rotation of the interaction member 30, in particular around axis F.

In particular, in use, upon rotation of the control ring around rotation axis F, interaction elements 29 and interaction members 30 interact with one another such that cutter 16 at least translates from the rest position to the operative position. In particular, the interaction of interaction elements 29 and interaction members 30 is such that, in use, upon rotation of the control ring a rototraslatory movement of cutter 16 is induced for moving cutter 16 from the rest position to the operative position. Even more particular, in use, upon rotation of the control ring cutter 16 translates along direction D and rotates around axis C.

Preferentially but not necessarily, the rototraslatory movement of cutter 16 is guided by cooperation of guiding element(s) 21 and cam profile 20.

Each interaction member 30 comprises an axial end portion 31, in particular distal to the control ring, and being arranged within a rotation plane orthogonal to rotation axis F and, in use, upon rotation of the control ring around rotation axis F, the rotation plane is fixed with respect to base frame 4 and/or package 2 and/or the designated pour opening surface area. In other words, interaction members 30 and the respective axial end portions 31 are not subjected to any translation with respect to base frame 4 and/or package 2 and/or the designated pour opening surface area.

According to the preferred non-limiting embodiment disclosed, each interaction member 30 rotates, in use, around axis F upon rotation of the control ring around axis F.

According to a preferred non-limiting embodiment, in use, the rotation of the control ring and the interaction members 30 around axis F is transformed into at least a translatory, preferentially a rototraslatory, movement of cutter 16 by means of the interaction between interaction members 30 and interaction elements 29 and the cooperation between cam profile 20 and guiding element(s) 21.

According to the preferred non-limiting embodiment disclosed, the control ring is defined by a portion of outlet cap 6, in particular by the coupling ring 27, and, accordingly, rotation of the control ring around axis F is, in use, actuated by means of a rotation of outlet cap 6 around rotation axis E. Additionally, interaction members 30 are connected to the portion of outlet cap 6 defining the control ring. In other words, outlet cap 6 comprises the control ring.

Alternatively, the control ring could be distinct from outlet cap 6.

Preferentially but not necessarily, each interaction element 29 is arranged on inner lateral surface 19 of cutter 16. In particular, each interaction element 29 protrudes away from inner lateral surface 19.

Preferentially but not necessarily, each interaction element 29 contacts the respective interaction member 30 when controlling, in use, operative assembly 5 from the rest configuration to the operative configuration.

Preferentially but not necessarily, each interaction element 30 protrudes from and/or extends from the control ring, in particular outlet cap 6, into inner space 13.

According to a preferred non-limiting embodiment, each interaction member 30 comprises an engagement surface 37 being in contact with the respective interaction element 29. In particular, each engagement surface 37 has a profile being inclined with respect to axis F.

According to a preferred non-limiting embodiment, in use, during movement of cutter 16 from the rest position to the operative position, each interaction element 29 slides along the respective engagement surface 37. In particular, while interaction members 30 and the respective engagement surface 37 are subjected to only a rotational movement around axis F, interaction elements 29 are subjected to both a rotation around axis F and a translation along direction D.

According to a preferred non-limiting embodiment, each interaction member 30 is realized in the form of a flap.

According to an alternative non-limiting embodiment, each interaction member 30 could be realized in any other manner, e.g. in the form of a guiding bar.

Figure 7:
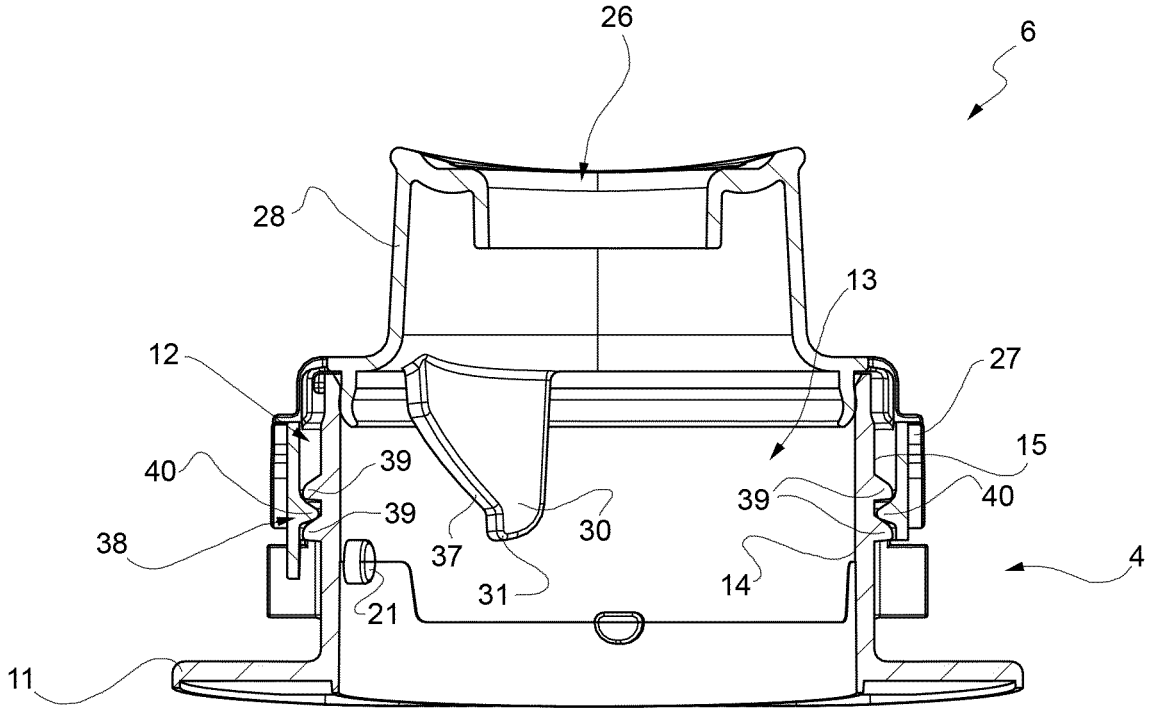
FIG. 7 is a sectionized view of details of the spout of FIGS. 1 to 4, with parts removed for clarity.

With particular reference to FIG. 7, spout 3 also comprises a coupling group 38 configured to couple the control ring and/or outlet cap 6 to base frame 4 in a manner that control ring and/or outlet cap 6 are rotatable around respectively axis F and axis E and a translation of control ring and/or outlet cap 6 with respect to base frame 4 is blocked and/or impeded.

According to a preferred non-limiting embodiment, coupling group 38 comprises at least one groove associated and/or connected to one of:

base frame 4 and/or collar 12 and/or outer surface 15; and the control ring and/or outlet cap 6 and/or coupling ring 27 and/or the inner surface of coupling ring 27.

In particular, coupling group 38 also comprises at least one, preferentially a plurality of, engagement members 40 configured to engage and/or engaging the groove and being associated to the other one of:

base frame 4 and/or collar 12 and/or outer surface 15; and the control ring and/or outlet cap 6 and/or coupling ring 27 and/or the inner surface of coupling ring 27.

According to a preferred non-limiting embodiment, the groove has an annular shape.

According to an alternative embodiment not shown, the groove could have an arc-shaped profile or could comprise a plurality of arc-shaped sections.

According to a preferred non-limiting embodiment, each engagement member 40 has an arc-shaped profile.

According to an alternative embodiment, engagement member 40 could have a circular shape.

With particular reference to FIG. 7, the groove is arranged on base frame 4, in particular collar 12, even more particular on outer surface 15.

According to the non-limiting embodiment shown, coupling group 38 comprises two annular protrusions 39 spaced apart from one another, protruding from base frame 24, in particular collar 12, even more particular outer surface 15 and defining the groove.

Preferentially but not necessarily, the groove and/or annular protrusions 39 are integral to base frame 4.

With particular reference to FIG. 7, each engagement member 40 is arranged on and protrudes from the control ring and/or outlet cap 6 and/or coupling ring 27 and/or the inner surface of coupling ring 27 into the groove.

Preferentially but not necessarily, each engagement member 40 is integral to the control ring and/or outlet cap 6 and/or coupling ring 27 and/or the inner surface of coupling ring 27.

According to a preferred non-limiting embodiment, the control device further comprises at least one engagement element 32 connected to the control ring, in particular outlet cap 6, and at least a first abutment element 33 and at least a second abutment element 34 coupled to and/or connected to and/or arranged on base frame 4 and being configured to interact with engagement element 32 and to define in cooperation respectively an angular start position and an angular end position of the control ring, in particular also of outlet cap 6.

In particular, with the control ring being arranged in the angular start position and the angular end position, outlet assembly 5 is controlled respectively in the rest configuration and the operative configuration of the opening assembly and/or cutter 16 respectively in the rest position and the operative position. In use, the control ring, in particular outlet cap 6, is rotated from the angular start position to the angular end position so as to control outlet assembly 5 from the rest configuration to the operative configuration and/or cutter 16 from the rest position to the operative position.

Preferentially but not necessarily, the angular start position and the angular end position are defined by engagement element 32 contacting respectively first abutment element 33 and second abutment element 34.

According to the preferred non-limiting embodiment shown, engagement element 32 is at least partially interposed between first abutment element 33 and second abutment element 34.

According to a preferred non-limiting embodiment, first abutment element 33 and second abutment element 34 are arranged such that, in use, a rotation of the control ring, in particular also of outlet cap 6, between 160° to 200°, in particular of substantially 180°, controls the control ring, in particular also outlet cap 6, from the angular start position to the angular end position.

More specifically, first abutment element 33 and second abutment element 34 are arranged on collar 12, in particular on outer surface 15. In particular, first abutment element 33 and second abutment element 34 are angularly displaced from one another.

Preferentially but not necessarily, first abutment element 33 and second abutment element 34 are integral to base frame 4, in particular to collar 12.

Figure 8:
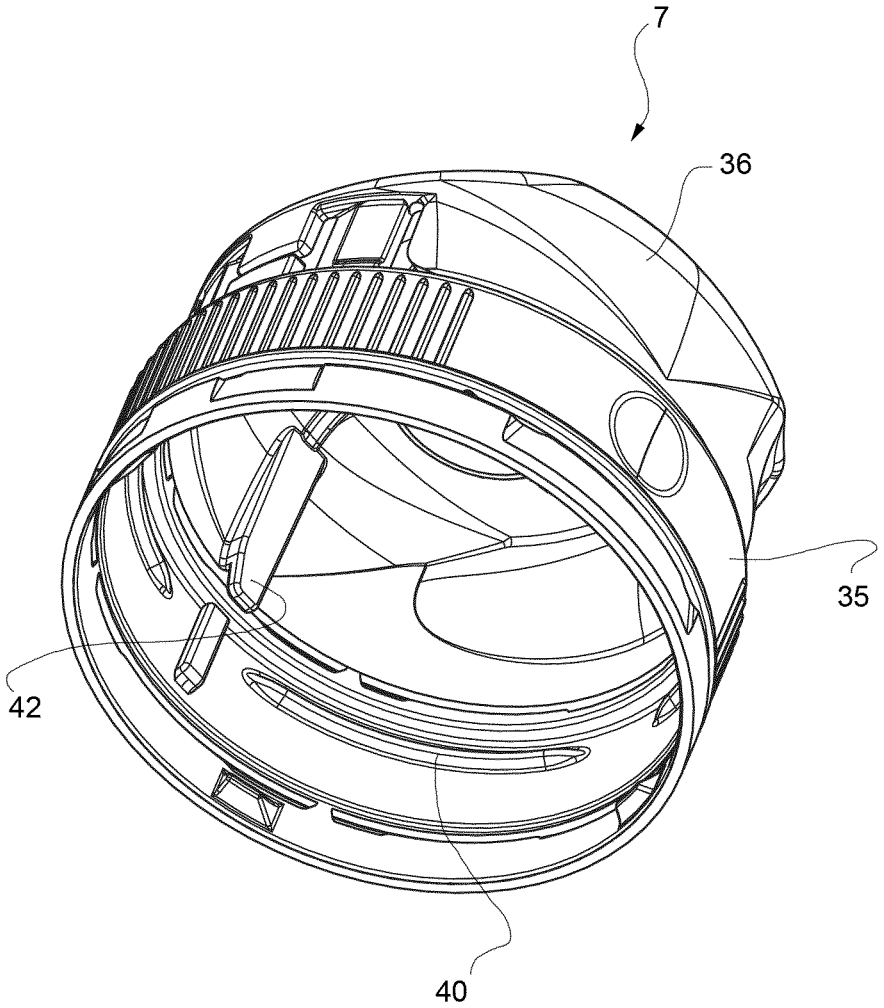
FIG. 8 is a perspective view of a further detail of the spout of FIGS. 1 to 4, with parts removed for clarity.
Figure 9:
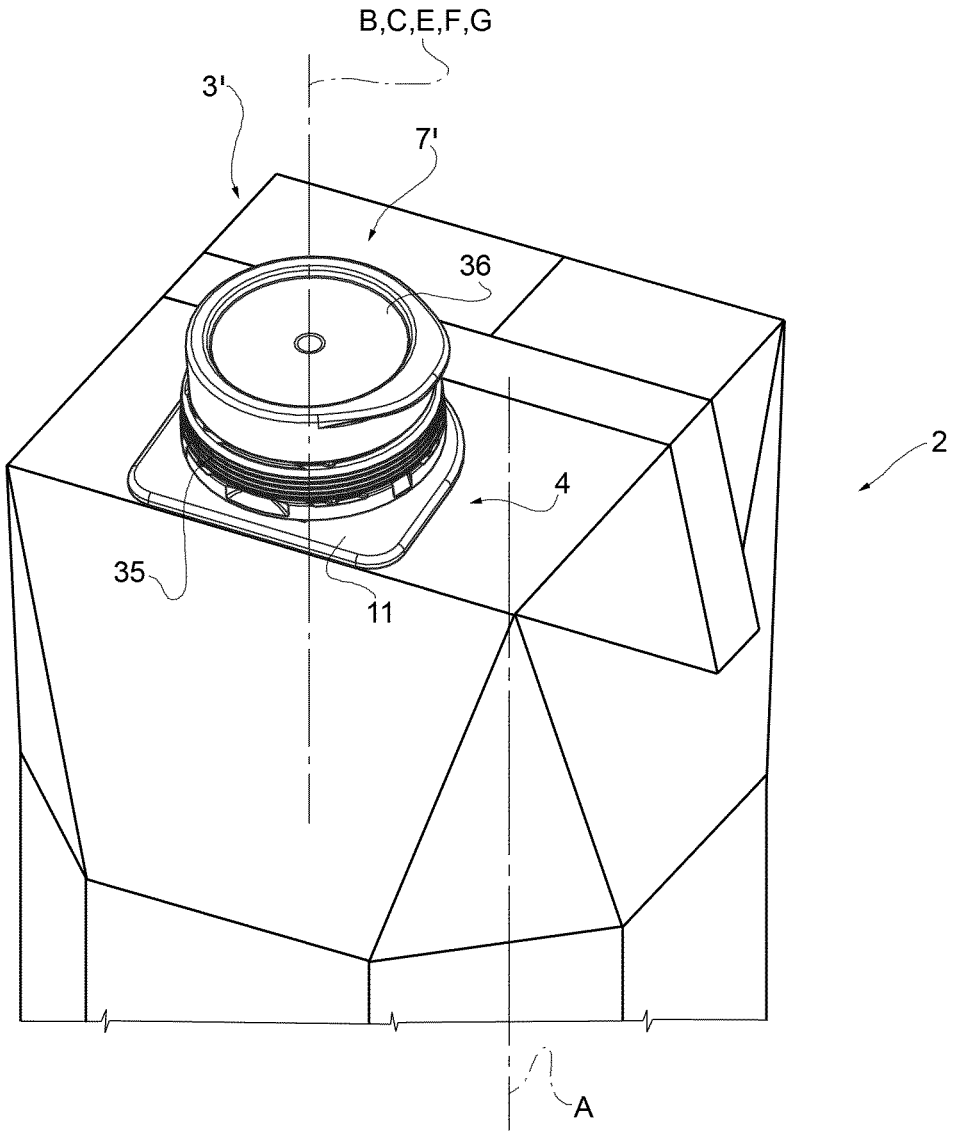
FIG. 9 is a schematic perspective view of a package-spout assembly having a spout according to a second embodiment of the present invention arranged in a first configuration, with parts removed for clarity.
Figure 10:
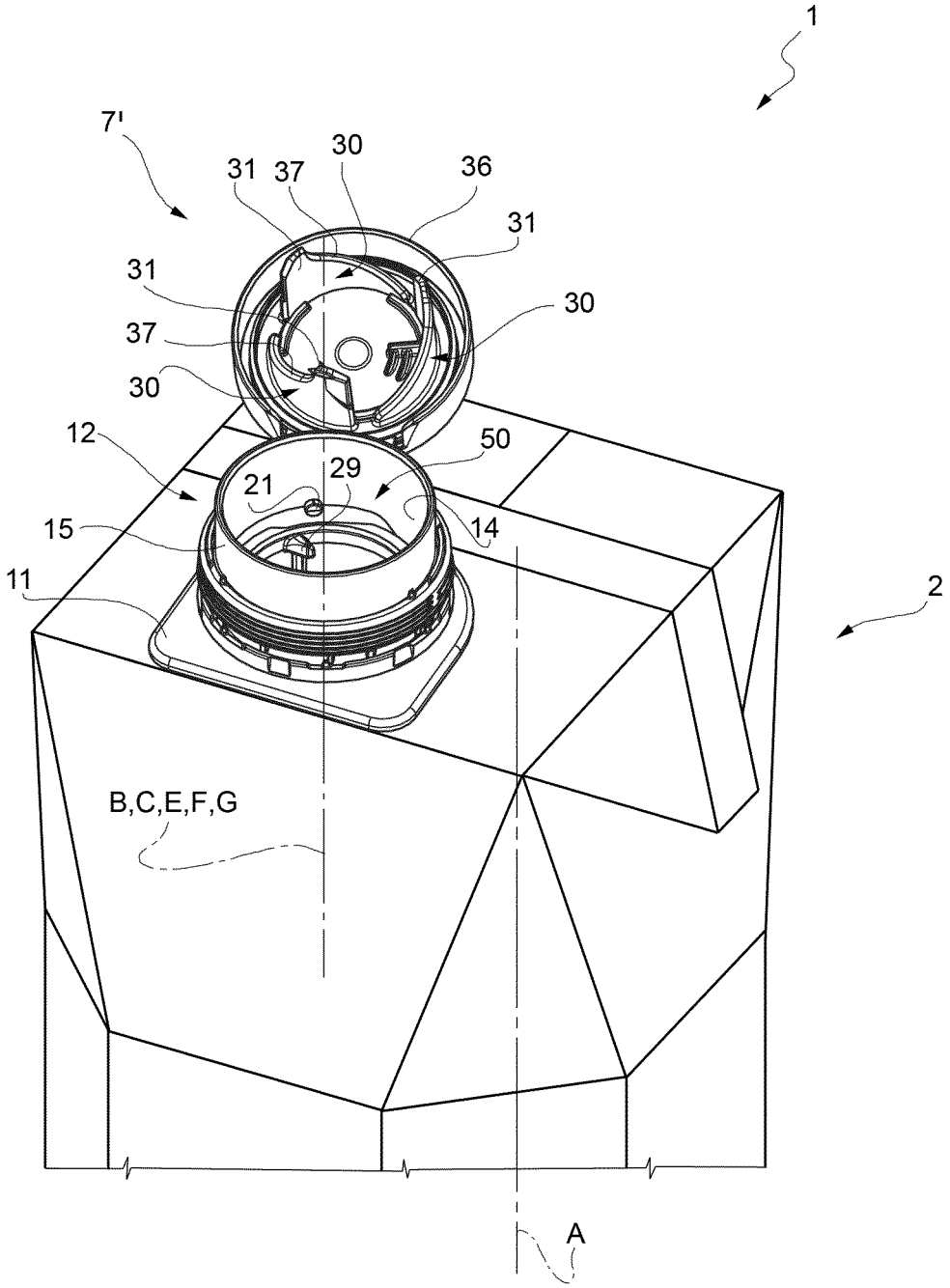
FIG. 10 is a schematic perspective view of the package-spout assembly of FIG. 18 with the spout being arranged in a second configuration, with parts removed for clarity.
Figure 11:
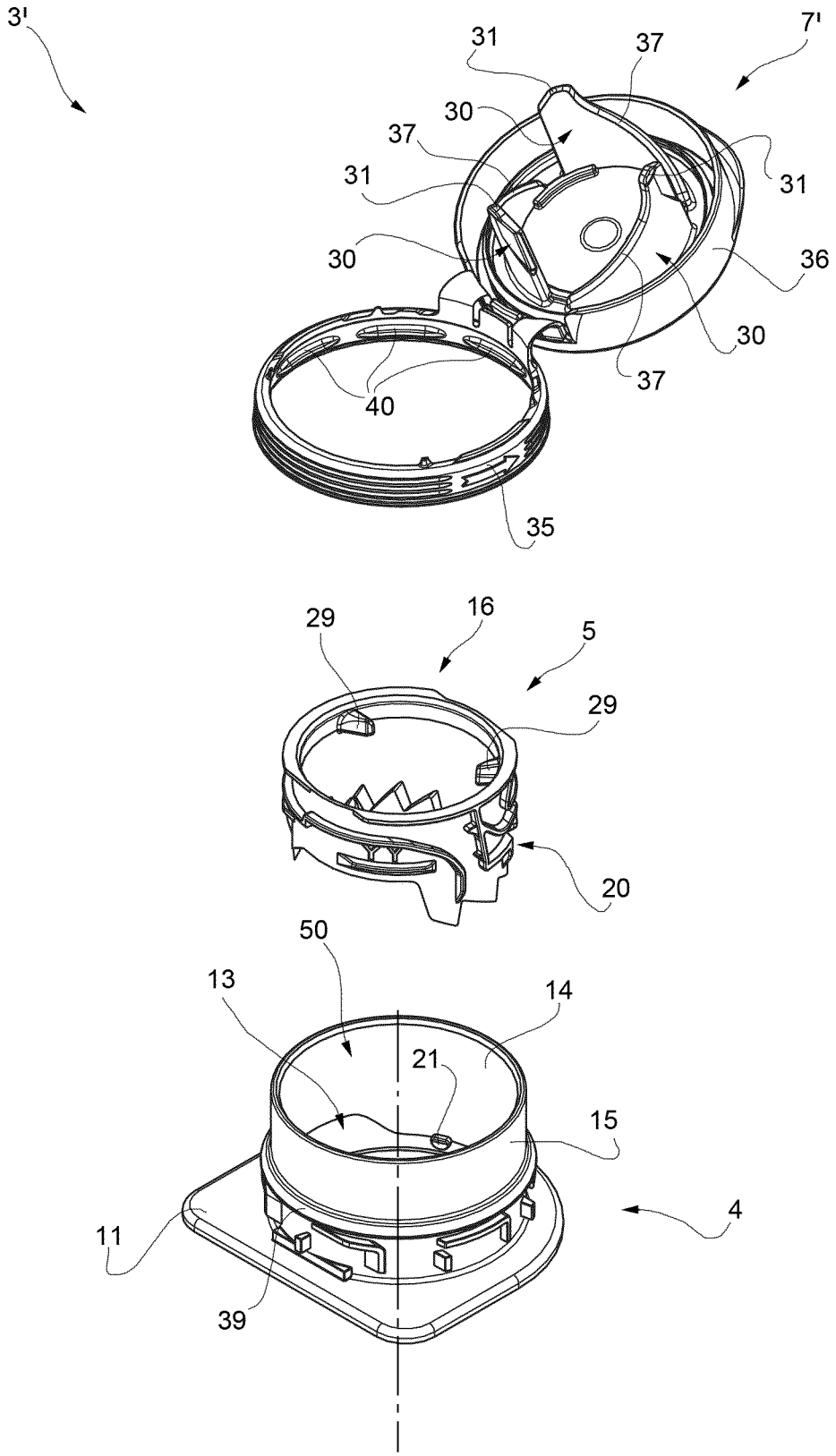
FIG. 11 is an exploded view of the spout of FIGS. 9 and 10, with parts removed for clarity.
Figure 12:
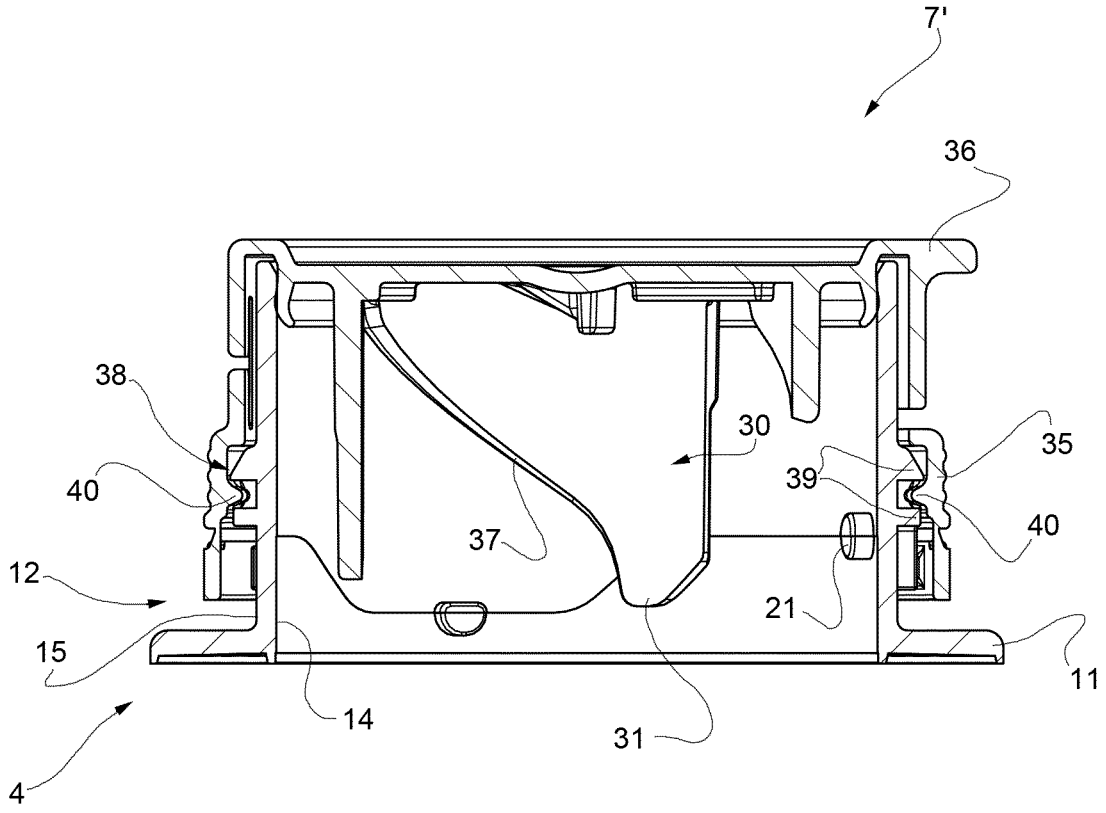
FIG. 12 is a sectionized view of details of the spout of FIGS. 9 to 11, with parts removed for clarity.

With particular reference to FIGS. 4 and 8, lid assembly 7 is configured to at least selectively close and open pouring outlet 26 (when being controlled in respectively the closing configuration and the opening configuration) so as to respectively hinder and allow the out-pouring of the pourable product.

Preferentially but not necessarily, lid assembly 7 comprises a ring-shaped frame 35 rotatable around a respective rotation axis G and being coupled to the control ring, in particular also outlet cap 6, in a manner that a rotation of the control ring, in particular also of outlet cap 6, results in a rotation of ring-shaped frame 35 and/or a rotation of ring-shaped frame 35 results in a rotation of the control ring, in particular also of outlet cap 6.

According to the preferred non-limiting embodiment shown, in use, a user contacts a portion of ring-shaped frame 35, rotates the ring-shaped frame 35 so as to contemporaneously actuate a rotation of the control ring and outlet cap 6.

Preferentially but not necessarily, lid assembly 7 also comprises a lid 36 hinged to ring-shaped frame 35 and being displaceable and/or controllable between at least a closing position in which lid 36 fully closes pouring outlet 26 and/or outlet cap 6, and an opening position in which lid 36 fully opens outlet cap 6 and/or pouring outlet 26.

Preferentially but not necessarily, lid 36 is also displaceable and/or controllable also in at least an intermediate position in which lid 36 partially opens outlet cap 6 and/or pouring outlet 26.

In particular, with lid 36 being in the closing position and the opening position, lid assembly 7 is controlled in respectively the closing configuration and the opening configuration. With lid 36 being controlled in the intermediate position lid assembly 7 is controlled in a respective intermediate configuration. The intermediate position of lid 36 is to be considered to form a help to the consumer, in particular during the first use of package 2.

According to a preferred non-limiting embodiment, spout 3 further comprises an actuating device configured to control lid 36 from the closing position to the intermediate position upon rotation of ring-shaped frame 35 around axis G.

In more detail, the actuating device comprises at least one cam element 41, in the specific case shown two, connected to and/or arranged on and/or integral to base frame 4, in particular collar 12, even more particular outer surface 15, and at least one counter-cam element 42, in the specific case shown two, connected to and/or arranged on and/or integral to lid 36 and being configured to interact with cam element 41 so as to exert, in use during at least a portion of the rotation of ring-shaped frame 35, a force on lid 36 so as to move lid 36 from the closed position to the intermediate position.

In particular, each cam element 41 and the respective counter-cam element 42 are arranged such that starting from at least a first defined angular position of ring-shaped frame 35, each cam element 41 and the respective counter-cam element 42 engage with one another so that upon further rotation of ring-shaped frame 35 the respective counter-cam element 42 advances along a cam-surface of cam element 41.

According to a preferred non-limiting embodiment, outlet cap 6 comprises at least one through-hole 43, in the specific case shown two, through which at least one respective counter-cam element 42 extends.

In use, a consumer actuates rotation of the control ring so as to control opening assembly 5 from the rest configuration to the operative configuration so that opening assembly 5 pierces and/or cuts and/or opens and/or ruptures the designated pour outlet surface area, in particular the separation membrane.

In particular, upon rotation of the control ring cutter 16 is translated towards and through the separation membrane.

According to the preferred non-limiting embodiment shown, the control ring is integral to outlet cap 6 and, thus, rotation of the control ring also means rotation of outlet cap 6. In particular, a consumer contacts and rotates ring-shaped frame 35 so as to induce rotation of the control ring and outlet cap 6.

During rotation of ring-shaped frame 35, the actuation device guarantees that lid 36 is controlled from the closing position to the intermediate position.

With reference to FIGS. 9 to 12, number 3' indicates an alternative embodiment of a spout according to the present invention; as spout 3' is similar to spout 3, the following description is limited to the differences between them, and using the same references, where possible, for identical or corresponding parts.

In particular, spout 3' differs from spout 3 in not comprising outlet cap 6. Alternatively, base frame 4 comprises and/or defines outlet cap 6.

According to a preferred non-limiting embodiment, spout 3', in particular base frame 4, even more particular collar 12, comprises a pouring outlet 50, in particular in fluid connection with inner space 13, and configured to allow a controlled out-pouring of the pourable product from package 2, in particular with the separation membrane having lost integrity.

According to the non-limiting embodiment shown in FIGS. 9 to 12, collar 12 has pouring outlet 50 and defines a mouthpiece of spout 3'.

In particular, spout 3' also differs from spout 3 in comprising lid assembly 7'. As lid assembly 7' is similar to lid assembly 7, the following description is limited to the differences between them, using the same references, if possible, for similar or corresponding parts.

In particular, lid assembly 7' is configured to at least selectively close or open pouring outlet 50. Accordingly, lid assembly 7' is controllable between at least respectively a closing configuration (see FIG. 9) in which lid assembly 7' closes and/or covers pouring outlet 50, in particular for hindering any out-pouring of the pourable product from package 2, and an open configuration (see FIG. 10) in which lid assembly 7' opens pouring outlet 50, in particular for allowing the out-pouring of the pourable product from package 2.

In particular, lid 36 of lid assembly 7' is controllable between a closing position and an opening position in which lid assembly 7' is controlled in respectively the closing configuration and the opening configuration; i.e. lid 36 closes and/or covers pouring outlet 50 and opens pouring outlet 50 with lid 36 being controlled in respectively the closing position and the opening position.

According to a preferred non-limiting embodiment, lid assembly 7' comprises the control device.

According to a preferred non-limiting embodiment, ring-shaped frame 35 of lid assembly 7' defines and/or comprises the control ring. In particular, axis F and axis G coincide.

Preferentially but not necessarily, coupling group 38 rotatably couples and/or connects ring-shaped frame 35 to base frame 4, in particular collar 12. In particular, ring-shaped-frame 35 carries one of the groove and engagement member(s) 40, in particular in the example shown engagement member(s) 40.

According to a preferred non-limiting embodiment, interaction members 30 are connected to lid assembly 7', in particular lid 36. Even more particular interaction members 30 protrude from lid 36.

According to a preferred non-limiting embodiment, interaction members 30 are connected to an inner surface of lid 36 facing base frame 4 and/or inner space 13 with lid 36 being arranged and/or moved and/or controlled in the closing position. In particular, with lid 36 being in the closing position, interaction members 30 protrude from the inner surface of lid 36 into inner space 13.

According to a preferred non-limiting embodiment, ring-shaped frame 35 (the control ring) and lid 36 are connected to one another. In particular, lid 36 is hinged to ring-shaped frame 35 (the control ring).

As the use of spout 3' is similar to the use of spout 3, the following description is limited to the differences between them.

In particular, in order to control and/or move opening assembly 5 from the rest configuration to the operative configuration, a consumer actuates rotation of ring-shaped frame 35 around axis G (and, accordingly, around axis F). The rotation of ring-shaped frame 35 results also in the rotation of interaction members 30 around axis F (and axis G). In particular, as lid 36 is connected and/or hinged to ring-shaped frame 35, the rotation of ring-shaped frame 35 is transferred to lid 36 and thereby to interaction members 30.

The advantages of spout 3 and spout 3' according to the present invention will be clear from the foregoing description.

In particular, spout 3 and spout 3' allow to pierce and/or cut and/or open and/or rupture the separation membrane without any parts getting detached from package-spout assembly 1 itself.

Another advantage is seen in allowing for the partial opening of lid 36 during rotation of ring-shaped frame 35. Facilitating the overall use of package-spout assembly 1.

Clearly, changes may be made to spout 3 and spout 3' as described herein without, however, departing from the scope of protection as defined in the accompanying claims.

The invention claimed is:

1. A spout for a sealed package filled with a pourable product;

the spout comprises at least:

a base frame configured to be fitted about a designated pour opening surface area of the sealed package;

an opening assembly moveably coupled to the base frame, the opening assembly comprising a movable cutter adapted to at least partially cut and/or rupture and/or open and/or pierce the designated pour opening surface area as the cutter moves from a rest configuration to an operative configuration; and a control device configured to interact with the cutter and to control movement of the cutter from the rest configuration to the operative configuration in which the cutter with the base frame being, in use, fitted about the designated pour opening surface area is configured to at least partially cut and/or rupture and/or open and/or pierce the designated pour opening surface area;

wherein the control device comprises:

at least one interaction element connected to the cutter so that the cutter and the interaction element move together;

at least one control ring rotatably coupled to the base frame around a respective rotation axis; and at least one interaction member connected to and/or coupled to the control ring and configured to interact with the interaction element;

wherein the interaction member is coupled and/or connected to the control ring such that a rotation of the control ring induces also a rotation of the interaction member;

wherein the interaction member comprises an axial end portion being arranged within a rotation plane being orthogonal to the rotation axis;

wherein, in use, upon rotation of the control ring around the rotation axis the interaction member interacts with the interaction element to induce a translation of the cutter of the opening assembly from the rest configuration to the operative configuration;

wherein, in use, upon rotation of the control ring the rotation plane is fixed with respect to the base frame.

2. The spout according to claim 1, wherein the control device further comprises at least one engagement element connected to the control ring, the control device further comprising at least a first abutment element and a second abutment element coupled to the base frame and being configured to interact with the engagement element and to define in cooperation respectively an angular start position and an angular end position of the control ring;

wherein the angular start position and the angular end position are defined by the engagement element contacting respectively the first abutment element and the second abutment element.

3. The spout according to claim 2, wherein the base frame comprises a collar, and the first abutment element and the second abutment element are arranged on an outer surface of the collar.

4. The spout according to claim 2, wherein the first abutment element and the second abutment element are arranged such that, in use, a rotation of the control ring between 160° to 200°, in particular of substantially 180°, controls the control ring from the start position to the end position.

5. The spout according to claim 1, and further comprising a cam group configured to guide movement of the cutter from a rest position to an operative position in which the opening assembly is in respectively the rest configuration and the operative configuration.

6. The spout according to claim 5, wherein the cam group comprises a cam profile and at least one guiding element;

wherein the cam profile and the guiding element are configured to guide in cooperation with one another the cutter during movement between the rest position and the operative position;

wherein one of the cam profile and the guiding element is connected to the base frame and the other one of the cam profile and the guiding element is connected to the cutter.

7. The spout according to claim 1, wherein the base frame comprises a collar delimiting an inner space;

wherein the opening assembly is arranged within the inner space and is at least partially in contact with an inner surface of the collar.

8. The spout according to claim 1, wherein the cutter is configured to rotate and translate during control of the opening assembly between the rest configuration and the operative configuration.

9. The spout according to claim 1, and further comprising an outlet cap rotatably coupled to the base frame and configured to allow, in use, the outflow of the pourable product from the package with the spout being arranged on the package;

wherein the outlet cap carries at least the control ring and the interaction member of the control device.

10. The spout according to claim 9, wherein the control ring and the interaction member are integral to the outlet cap and a rotation of the outlet cap results, in use, in a rotation of the control ring.

11. The spout according to claim 9, and further comprising:

a pouring outlet configured to allow a controlled out-pouring of the pourable product; and a lid assembly for at least selectively closing or opening the pouring outlet and being controllable between at least a closing configuration in which the lid assembly closes the pouring outlet and an open configuration in which the lid assembly opens the pouring outlet.

12. The spout according to claim 11, wherein the lid assembly comprises a rotatable ring-shaped frame coupled to the control ring in a manner that a rotation of the control ring results in a rotation of the ring-shaped frame and/or a rotation of the ring-shaped frame results in a rotation of the control ring;

wherein the lid assembly further comprises a lid hinged to the ring-shaped frame and being displaceable between at least a closing position in which the lid fully closes the pouring outlet, at least an intermediate position in which the lid partially opens the pouring outlet and an opening position in which the lid fully opens the pouring outlet;

wherein the spout further comprises an actuating device configured to control the lid from the closing position to the intermediate position upon rotation of the ring-shaped frame.

13. The spout according to claim 12, wherein the actuating device comprises at least one cam element connected to the base frame and at least one counter-cam element connected to the lid and being configured to interact with the cam element so as to exert, in use during at least a portion of the rotation of the ring-shaped frame, a force on the lid so as to move the lid from the closing position to the intermediate position.

14. The spout according to claim 13, wherein the outlet cap comprises at least one through-hole through which the at least one counter-cam element extends.

15. The spout according to claim 11, wherein the interaction member is connected to the lid assembly.

16. A package-spout assembly comprising a sealed package filled with a pourable product comprising a designated pour outlet surface area and a spout according to claim 1 fitted about the designated pour outlet surface area.

17. A spout for a sealed package filled with a pourable product, the spout comprising:

a base frame configured to be fitted about a designated pour opening surface area of the sealed package;

a ring rotatably coupled to the base frame to rotate relative to the base frame about an axially extending rotation axis;

a cutter movably coupled to the base frame to at least partially cut and/or rupture and/or open and/or pierce the designated pour opening surface area as the cutter moves from a rest configuration to an operative configuration;

an interaction element connected to the cutter so that the cutter and the interaction element move together;

an interaction member configured to interact with the interaction element so that the interaction of the interaction member with the interaction element during the rotation of the ring around the rotation axis induces translation of the cutter from the rest configuration to the operative configuration;

a pouring outlet configured to allow out-pouring of the pourable product;

a hinged lid that is rotatable relative to the base frame and that is displaceable during hinged movement of the lid between a closing position in which the pouring outlet is closed by the lid and an opening position in which the lid is moved away from the pouring outlet so that the pouring outlet is open;

the base frame including one of a cam or a counter-cam, the lid including the other one of the cam or the counter-cam, the counter-cam being an axially extending linear counter-cam that is linear and that extends axially, the cam and the axially extending linear counter-cam being configured and positioned to interact with one another during rotation of the lid relative to the base frame to effect the hinged movement of the lid from the closing position to an intermediate position between the closing position and the opening position; and the interaction member comprising an axial end portion arranged within a rotation plane that is orthogonal to the rotation axis.

18. The spout according to claim 17, wherein the axially extending linear counter-cam is a first axially extending linear counter-cam, and comprising a second axially extending linear counter-cam that is linear and that extends axially, the first axially extending linear counter-cam being circumferentially spaced apart from the second axially extending linear counter-cam.

19. The spout according to claim 17, wherein the axially extending rotation axis extends in an axial direction, the axially extending linear counter-cam including spaced-apart sides that extend in the axial direction and that terminate at a free end of the counter-cam that is configured and positioned to interact with the cam during rotation of the lid relative to the base frame to effect the hinged movement of the lid from the closing position to the intermediate position.

20. A spout for a sealed package filled with a pourable product, the spout comprising:

a base frame configured to be fitted about a designated pour opening surface area of the sealed package;

a control ring rotatably coupled to the base frame to rotate relative to the base frame about a rotation axis;

a cutter movably coupled to the base frame to at least partially cut and/or rupture and/or open and/or pierce the designated pour opening surface area as the cutter moves from a rest configuration to an operative configuration;

a projection connected to the cutter so that the cutter and the projection move together;

a flap connected to and/or coupled to the control ring so that rotation of the control ring results in rotation of the flap, the flap protruding away from the control ring and including an engagement surface that is inclined and that terminates at an axial end portion of the flap;

the inclined engagement surface of the flap being configured to contact the projection during rotation of the control ring so that the contact between the inclined engagement surface and the projection causes the projection and the cutter to rotate and to translate toward the designated pour opening surface area so that the cutter moves from the rest configuration to the operative configuration; and the axial end portion of the flap being arranged within a rotation plane that is orthogonal to the rotation axis.

21. The spout according to claim 20, further comprising:

a pouring outlet configured to allow out-pouring of the pourable product;

a hinged lid that is displaceable during hinged movement of the lid between a closing position in which the pouring outlet is closed by the lid and an opening position in which the lid is moved away from the pouring outlet so that the pouring outlet is open, the lid being rotatable relative to the base frame; and the base frame including one of a cam or a counter-cam, the lid including the other one of the cam or the counter-cam, the cam and the counter-cam contacting one another during rotation of the lid relative to the base frame to effect the hinged movement of the lid from the closing position to an intermediate position between the closing position and the opening position.

* * * * *